United States Patent [19]

Punako et al.

[11] Patent Number: 4,810,209

[45] Date of Patent: Mar. 7, 1989

[54] PRESSURIZED ELECTRICAL CONNECTOR AND METHOD OF ASSEMBLY

[75] Inventors: Stephen Punako, Bainbridge, N.Y.; Warren R. Williams, Jr., Montrose, Pa.; David O. Gallusser, Oneonta, N.Y.

[73] Assignee: Amphenol Corporation, Wallingford, Conn.

[21] Appl. No.: 55,203

[22] Filed: May 28, 1987

[51] Int. Cl.[4] ..... H01R 13/40

[52] U.S. Cl. ..... 439/589; 439/271

[58] Field of Search ..... 439/170–174, 439/271, 275, 276, 166, 281–284, 351, 290–292, 312–313, 371, 586–588, 592, 598, 299, 603

[56] References Cited

U.S. PATENT DOCUMENTS 4,632,482 12/1986 Punako et al. ..... 439/271

4,682,832 7/1987 Punako et al. ..... 439/589

*Primary Examiner*—Gil Weidenfeld
*Assistant Examiner*—P. Austin Bradley
*Attorney, Agent, or Firm*—Bacon & Thomas

[57] ABSTRACT

An electrical connector capable of withstanding a predetermined pressure differential without leakage and a predetermined axial load without dislocation of insert assemblies from their normal position in the connector shell is disclosed. The connector includes one insert assembly which may be a pin or socket insert assembly and an other insert assembly which is a socket insert assembly. The one and the other insert assemblies include contacts arranged in "piggy-back" relation. The one insert assembly is ring staked to the connector shell and the socket insert assembly is bonded to a grommet and sealed in the shell.

17 Claims, 2 Drawing Sheets

PRESSURIZED ELECTRICAL CONNECTOR AND METHOD OF ASSEMBLY

BACKGROUND OF THE INVENTION

This invention relates to pressurized electrical connectors of the type including pin and socket insert assemblies having captivated "piggy-back" contacts.

Electrical connectors are used in applications where they must withstand, for example, a pressure differential of fifty p.s.i. Moreover, these connectors must be capable of withstanding significant axial loads without their pin and socket inserts being dislocated from their normal position in the connector shell.

The present invention accomplishes the above by providing a bonded and sealed connector with crimp removable contacts. A front insert assembly and contacts are fully staked and bonded in place. A rear insert assembly is retained and bonded in place with crimp removable contacts. Appropriate static loading and leak testing have shown that connectors so constructed meet the aforenoted pressure and loading requirements.

SUMMARY OF THE INVENTION

This invention contemplates a pressurized electrical connector and method of assembly, including a first pin or socket insert assembly and a second socket insert assembly having captivated internal contacts disposed in "piggy-back" relation, i.e. the contacts of the first insert assembly disposed above the contacts of the second insert assembly. The first insert assembly is ring-staked to the connector shell and the second insert assembly is bonded to a connector grommet and then sealed in the shell.

Accordingly, the invention describes and claims an electrical connector and method of assembly comprising a first insert assembly having captivated internal contacts; a second insert assembly having captivated internal contacts; the contacts of the first insert assembly disposed above the contacts of the second insert assembly; a connector shell; an internal ring stake undercut carried by the shell; a ring arranged with the first and second insert assemblies; said ring being in cooperative arrangement with said shell undercut for enabling the first insert assembly to be ring-staked to the shell; a connector grommet; means for bonding the second insert assembly to the grommet; and means for staking and sealing the second insert assembly to the shell.

DETAILED DESCRIPTION OF THE INVENTION

Figure 1:
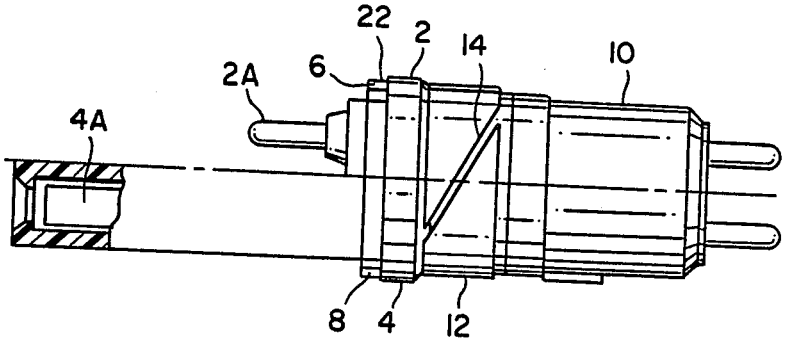
FIG. 1 is a diagrammatic, partially sectioned plan view showing first and second insert assemblies according to the invention.

With reference to the drawing, and with particular reference first to FIG. 1, a pin insert assembly 2 has contacts 2A and a socket insert assembly 4 has contacts 4A. It will be understood that although insert assembly 2 is shown and described for purposes of illustration as a pin insert assembly, it could be a socket insert assembly and would satisfy the intent of the invention as well. Contacts 2A are disposed above contacts 4A in "piggy-back" fashion as will be discerned from the drawing and the description to follow. Pin insert assembly 2 includes a key 6 and socket insert assembly 4 includes a key 8.

A rubber grommet 10 is disposed near the tail end of the insert assemblies. A metal ring 12 having a split 14 is disposed ahead of grommet 10.

Figure 2:
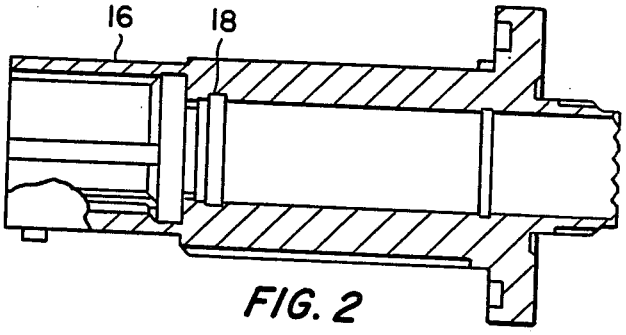
FIG. 2 is a diagrammatic, partially sectioned plan view showing a connector shell according to the invention.
Figure 3:
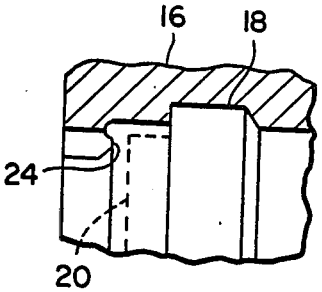
FIG. 3 is an enlarged diagrammatic representation showing a section of FIG. 2.

With reference to FIGS. 2 and 3, a connector shell is designated by the numeral 16. As best shown in FIG. 3 shell 16 has an internal ring stake undercut 18, whereby pin insert assembly 2 is ring-staked to shell 16 via ring 12.

With further reference to FIG. 3, shell 16 has an internal circumferential surface 20 to which a suitable sealant adhesive is applied to provide a seal between pin insert assembly 2 and shell 16. Alternately, the sealant adhesive may be applied to an external circumferential area 22 of pin insert assembly 2 shown in FIG. 1.

With reference again to FIG. 1, pin and socket contacts 2A and 4A are assemblied to pin insert assembly 2 and socket insert assembly 4, respectively, so as to be captivated therein, as will be understood by those skilled in the art. Contacts 2A are unremovable and contacts 4A are unremovable. Care must be taken during this assembly not to contaminate any adhesive coated surfaces. Further no lubricant is required, nor is a lubricant to be used. Any adhesive that is to be used must not enter metal ring stake undercut 18 (FIG. 3), as will be appreciated by those skilled in the art.

Ring 12 is assembled to insert assembly 2 (FIG. 1). The position of split 14 of ring 12 must not be positioned behind either of the insert keys 6 and 8.

Figure 4:
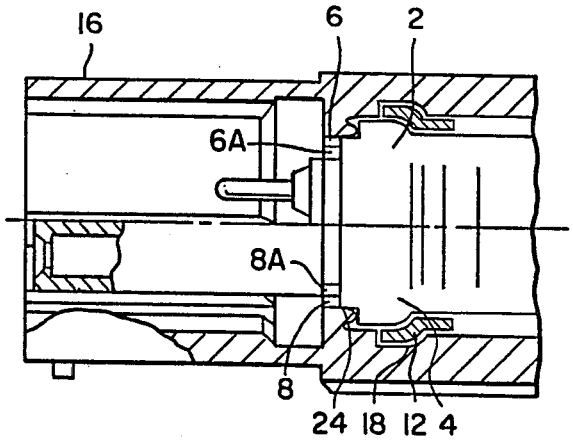
FIG. 4 is a diagrammatic, partially sectioned plan view showing the structural relationship of the first insert assembly, the second insert assembly and the shell according to the invention.

The assembly so provided is assembled into shell 16 (see FIG. 4), making sure that the assembly is seated and retained against a shoulder 24 of shell 16 and that insert keys 6 and 8 are aligned with corresponding shell keyways 6A and 8A, respectively. Pressure is applied to ring 12 to insure that the assembly is fully seated, and for this purpose ring 12 may be of a sufficiently deformable grade of aluminum or some other like metal so as to be deformed as shown in FIG. 4 to accomplish said seating and retention.

Figure 5:
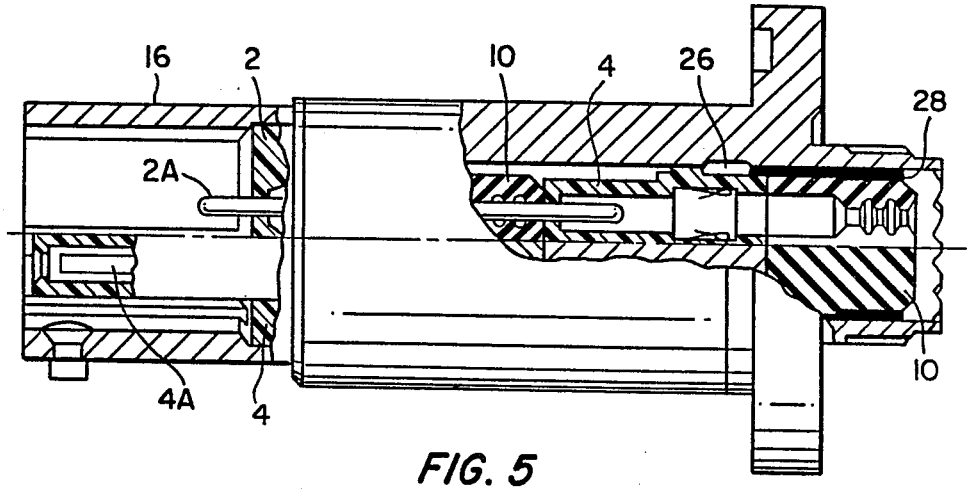
FIG. 5 is a diagrammatic, partially sectioned, cutaway plan view of the connector of the invention.

With reference to FIG. 5, socket insert assembly 4 is positioned on grommet 10 to create the aforenoted "piggy-back" relation. A retaining ring 26 holds insert assembly 4 in place. A sufficient sealant adhesive 28 is applied between shell 16 and insert assembly 4 to provide a seal between the shell and the insert assembly. Care must be exercised to ensure that the adhesive sealant does not interfere with the assembly of accessories, as might otherwise be the case. Socket contacts 4A can then be inserted into insert assembly 4 and are removable.

With the connector of the invention configured and assembled as described, a connector is provided which will withstand predetermined axial loads without insert assemblies 2 and 4 being dislocated from their normal positions within shell 16, and the connector will be leak tight while sustaining a predetermined pressure differential.

It will be understood that in assembling the disclosed connector, conventional procedures well known in the art should be followed. That is to say, prior to assembly all components should be cleaned in the vapor phase of a suitable solvent, with excess solvent blown dry with air from an oil-free air source. The insert assemblies should be properly treated and the adhesive sealant must be applied within a prescribed interval after said treatment. Excess adhesive sealant must be removed with a suitable solvent, and appropriate curing procedures should be followed.

With the aforegoing description of the invention in mind reference is made to the claims appended hereto for a definition of the scope of the invention.

What is claimed is:

1. An electrical connector, comprising:

a first insert assembly having unremovable captivated internal contacts;

a second insert assembly having removable captivated internal contacts;

the contacts of the first insert assembly disposed above the contacts of the second insert assembly;

a connector shell;

an internal ring stake undercut carried by the shell;

a ring arranged with the first and second insert assemblies;

said ring being in cooperative arrangement with said shell undercut for enabling the first insert assembly to be ring staked to the shell;

a connector grommet;

means for bonding the second insert assembly to the grommet; and means for sealing the second insert assembly to the shell.

2. An electrical connector as described by claim 1, wherein said ring being in cooperative relation with said shell includes:

said ring being of a deformable material; and pressure being applied to said ring, whereby said ring is deformed to be fully seated in said shell undercut and against a shell shoulder.

3. An electrical connector as described by claim 1, including:

the shell having an internal circumferential surface for receiving a sealant adhesive whereby a seal is provided between the first insert assembly and the shell.

4. An electrical connector as described by claim 1, including:

the first insert assembly having an external circumferential surface for receiving a sealant adhesive, whereby a seal is provided between said first insert assembly and the shell.

5. An electrical connector as described by claim 1, including:

the second insert assembly being positioned on the grommet for being bonded thereto;

a retaining ring for holding the second insert assembly in position on the grommet; and means disposed between the shell and the second insert assembly to provide a seal therebetween.

6. An electrical connector as described by claim 5, wherein:

the means disposed between the shell and the second insert assembly to provide a seal therebetween is a sealant adhesive.

7. An electrical connector, comprising:

one insert assembly of a pin insert assembly and a socket insert assembly, said one insert assembly having unremovable captivated internal contacts;

a socket insert assembly having removable captivated internal contacts;

the contacts of the one insert assembly disposed above the contacts of the socket insert assembly;

a connector shell;

an internal ring stake undercut carried by the shell;

a ring arranged with the one and the socket insert assemblies;

said ring being in cooperative arrangement with said shell undercut for enabling the one insert assembly to be ring staked to the shell;

a connector grommet;

means for bonding the socket insert assembly to the grommet; and means for sealing the socket insert assembly to the shell.

8. An electrical connector as described by claim 7, wherein said ring being in cooperative relation with said shell includes:

said ring being of a deformable material; and pressure being applied to said ring, whereby said ring is deformed to be fully seated in said shell undercut and against a shell shoulder.

9. An electrical connector as described by claim 7, including:

the socket insert assembly being positioned on the grommet for being bonded thereto;

a retaining ring for holding the socket insert assembly in position on the grommet; and means disposed between the shell and the socket insert assembly to provide a seal therebetween.

10. An electrical connector as described by claim 7, wherein;

the means disposed between the shell and the socket insert assembly to provide a seal therebetween is a sealant adhesive.

11. An electrical connector as described by claim 7, including:

the shell having an internal circumferential surface for receiving a sealant adhesive whereby a seal is provided between the one insert assembly and the shell.

12. An electrical connector as described by claim 7, including:

the one insert assembly having an external circumferential surface for receiving a sealant adhesive, whereby a seal is provided between the one insert assembly and the shell.

13. A method for assembling an electrical connector, comprising:

disposing one insert assembly of a pin insert assembly or socket insert assembly and having captivated unremovable contacts above a socket insert assembly having captivated removable contacts;

providing an internal ring stake undercut in a connector shell;

arranging a ring with the one and the socket insert assemblies and with the connector shell for enabling the one insert assembly to be ring staked to the shell;

bonding the socket insert assembly to a connector grommet; and sealing the socket insert assembly in the shell.

14. A method as described by claim 13, wherein arranging a ring with the one and the socket insert assemblies and with the connector shell includes:

deforming the ring to fully seat the ring in an internal ring stake undercut carried by the shell.

15. A method as described by claim 13, including:

positioning the socket insert assembly on the grommet for bonding said insert assembly to said grommet;

retaining the socket insert assembly in position on the grommet; and providing a seal between the shell and the socket insert assembly.

16. A method as described by claim 13, including:

providing an internal circumferential surface on the shell for receiving a sealant adhesive for providing a seal between the one insert assembly and the shell.

17. A method as described by claim 13, including:

providing an external surface on the one insert assembly for receiving a sealant adhesive for providing a seal between the one insert assembly and the shell.

* * * * *